US007035792B2

(12) United States Patent
Chang et al.

(10) Patent No.: US 7,035,792 B2
(45) Date of Patent: *Apr. 25, 2006

(54) SPEECH RECOGNITION USING DUAL-PASS PITCH TRACKING

(75) Inventors: Eric I-Chao Chang, Beijing (CN); Jian-Lai Zhou, Beijing (CN)

(73) Assignee: Microsoft Corporation, Redmond, WA (US)

( * ) Notice: Subject to any disclaimer, the term of this patent is extended or adjusted under 35 U.S.C. 154(b) by 143 days.

This patent is subject to a terminal disclaimer.

(21) Appl. No.: 10/860,344

(22) Filed: Jun. 2, 2004

(65) Prior Publication Data

US 2004/0220802 A1 Nov. 4, 2004

Related U.S. Application Data

(63) Continuation of application No. 09/843,212, filed on Apr. 24, 2001, now Pat. No. 6,917,912.

(51) Int. Cl.
*G10L 11/04* (2006.01)

(52) U.S. Cl. ..... 704/207; 704/223; 704/219

(58) Field of Classification Search ..... 704/207, 704/219, 220, 223

See application file for complete search history.

(56) References Cited

U.S. PATENT DOCUMENTS 4,696,038 A * 9/1987 Doddington et al. ..... 704/219
4,731,846 A * 3/1988 Secrest et al. ..... 704/207

(Continued)

FOREIGN PATENT DOCUMENTS

WO WO 99/59138 11/1999

OTHER PUBLICATIONS

D. Tuffelli; "A pitch detection algorithm with hypothesis and test strategy by means of fast surface AMDF" Acoustics Speech and Signal Processing IEEE International Conference on ICASSP '84 vol. 9 Mar. 1984 pp. 81-84.

(Continued)

*Primary Examiner*—Susan McFadden
*Assistant Examiner*—Huyen X. Vo
(74) *Attorney, Agent, or Firm*—Lee & Hayes PLLC

(57) ABSTRACT

A computationally efficient and robust pitch detection and tracking system and related methods are presented. According to certain exemplary implementations a method is presented comprising identifying an initial set of pitch period candidates using a first estimation algorithm, filtering the initial set of candidates and passing the filtered candidates through a second, more accurate pitch estimation algorithm to generate a final set of pitch period candidates from which the most likely pitch value is selected.

27 Claims, 5 Drawing Sheets

U.S. PATENT DOCUMENTS

| | | | | |
|---|---|---|---|---|
| 4,924,508 | A * | 5/1990 | Crepy et al. | 704/207 |
| 5,353,372 | A | 10/1994 | Cook et al. | |
| 5,704,000 | A * | 12/1997 | Swaminathan et al. | 704/207 |
| 5,890,108 | A | 3/1999 | Yeldener | |
| 6,138,092 | A | 10/2000 | Zinser, Jr. et al. | |
| 6,226,606 | B1 | 5/2001 | Acero et al. | |
| 6,456,965 | B1 * | 9/2002 | Yeldener | 704/207 |
| 6,463,406 | B1 | 10/2002 | McCree et al. | |
| 6,470,309 | B1 | 10/2002 | McCree et al. | |
| 6,496,797 | B1 * | 12/2002 | Redkov et al. | 704/220 |
| 6,587,816 | B1 | 7/2003 | Chazan et al. | |
| 6,675,144 | B1 | 1/2004 | Tucker et al. | |

OTHER PUBLICATIONS

Parsons; "Voice and Speech Processing" pp. 199-203 McGraw-Hill (1987).

Ross et al.; "Average Magnitudde Difference Function Pitch Extractor"; Oct. 1974; pp. 353-362.

Change et al.; "Large Vocabulary Mandarin Speech Recognition With Different Approaches In Modeling Tones"; pp. 1-4.

Talkin; "A Robust Algorithm For Pitch Tracking (RAPT)"; 1995; pp. 502-518.

* cited by examiner

SPEECH RECOGNITION USING DUAL-PASS PITCH TRACKING

RELATED APPLICATIONS

This is a continuation of U.S. patent application Ser. No. 09/843,212 entitled, "A Method And Apparatus For Tracking Pitch In Audio Analysis," to Eric I-Chao Chang and Jian Lai Zhou, filed Apr. 24, 2001 now U.S. Pat. No. 6,917,912.

TECHNICAL FIELD

This invention generally relates to speech recognition systems and, more particularly, to a method and apparatus for tracking pitch in the analysis of audio content.

BACKGROUND

Recent advances in computing power and related technology have fostered the development of a new generation of powerful software applications including web-browsers, word processing and speech recognition applications. Newer speech recognition applications similarly offer a wide variety of features with impressive recognition and prediction accuracy rates. In order to be useful to an end-user, however, these features must execute in substantially real-time.

Despite the advances in computing system technology, achieving real-time performance in speech recognition systems remains quite a challenge. Often, speech recognition systems must trade-off performance with accuracy. Accurate speech recognition systems typically rely on digital signal processing algorithms and complex statistical models, generated from large speech and textual corpora.

In addition to the computational complexity of the language model, another challenge to accurate speech recognition is to accurately model and predict the voice characteristics of the speaker. Indeed, in certain languages, the entire meaning of a word is conveyed in the tone of the word, i.e., the pitch of the speech. Many oriental languages are tonal language, wherein the meaning of the word is partially conveyed in the pitch (or tone) in which it is presented. Thus, speech recognition for such tonal languages must include a pitch tracking algorithm that can track changes in pitch (tone) in near real-time. As with the language model above, for very large vocabulary continuous speech recognition systems, in order to be useful, a pitch tracking system must be fast while providing an accurate estimate of fundamental frequency. Unfortunately, in order to provide acceptably accurate results, conventional pitch tracking systems are often slow, as the algorithms which analyze and track voice content for fundamental pitch values are computationally expensive and time consuming—unsuited for real-time interactive applications such as, for example, a computer interface technology.

Thus, a method and apparatus for pitch tracking in audio analysis applications is required, unencumbered by the deficiencies and limitations commonly associated with prior art language modeling techniques.

SUMMARY

In accordance with certain exemplary implementations, a method is presented comprising identifying an initial set of pitch period candidates using a fast first pass pitch estimation algorithm, filtering the initial set of candidates and passing the filtered candidates through a second, more accurate pitch estimation algorithm to generate a final set of pitch period candidates from which the most likely pitch value is selected. It will be appreciated that the dual pass pitch tracker, using two different, increasingly complex pitch estimation algorithms on a decreasing pitch candidate sample provides near-real time capability while limiting degradation in accuracy.

BRIEF DESCRIPTION OF THE DRAWINGS

The same reference numbers are used throughout the figures to reference like components and features.

DETAILED DESCRIPTION

This invention concerns a method and apparatus for detecting and tracking pitch in support of audio content analysis. As disclosed herein, the invention is described in the broad general context of computing systems of a heterogeneous network executing program modules to perform one or more tasks. Generally, these program modules include routines, programs, objects, components, data structures, etc. that perform particular tasks or implement particular abstract data types. In this case, the program modules may well be included within the operating system or basic input/output system (BIOS) of a computing system to facilitate the streaming of media content through heterogeneous network elements.

As used herein, the working definition of computing system is quite broad, as the teachings of the present invention may well be advantageously applied to a number of electronic appliances including, but not limited to, hand-held devices, communication devices, KIOSKs, personal digital assistants, multiprocessor systems, microprocessor-based or programmable consumer electronics, network PCs, minicomputers, mainframe computers, wired network elements (routers, hubs, switches, etc.), wireless network elements (e.g., base stations, switches, control centers), and the like. It is noted, however, that modification to the architecture and methods described herein may well be made without deviating from spirit and scope of the present invention.

Example Computing Environment

Figure 1:
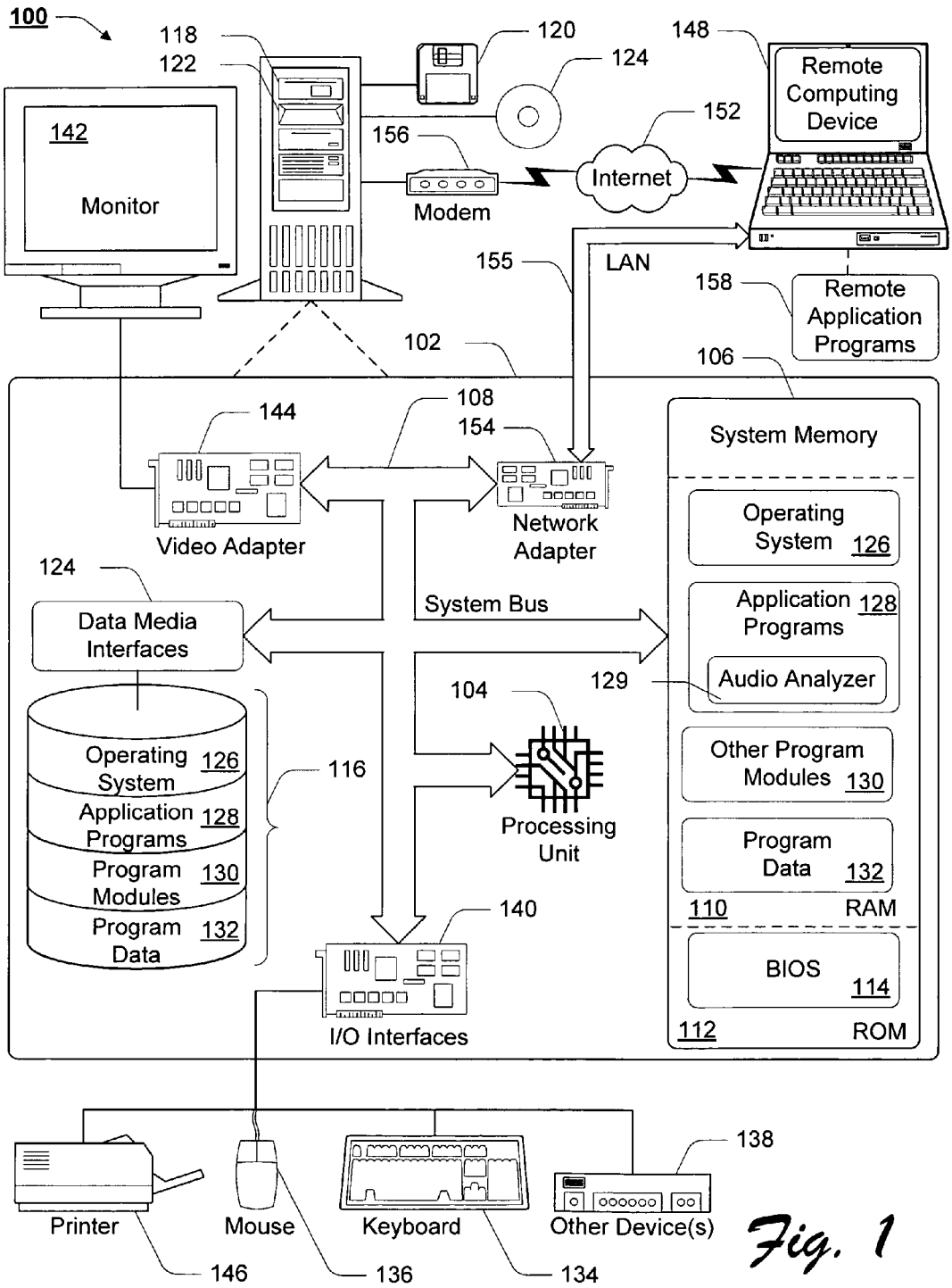
FIG. 1 is a block diagram of an example computing system.

FIG. 1 illustrates an example of a suitable computing environment 100 within which to practice the innovative audio analyzer of the present invention. It should be appreciated that computing environment 100 is only one example of a suitable computing environment and is not intended to suggest any limitation as to the scope of use or functionality of the streaming architecture. Neither should the computing environment 100 be interpreted as having any dependency or requirement relating to any one or combination of components illustrated in the exemplary computing environment 100.

The example computing system 100 is operational with numerous other general purpose or special purpose computing system environments or configurations. Examples of well known computing systems, environments, and/or configurations that may well benefit from the heterogeneous network transport layer protocol and dynamic, channel-adaptive error control schemes described herein include, but are not limited to, personal computers, server computers, thin clients, thick clients, hand-held or laptop devices, multiprocessor systems, microprocessor-based systems, set top boxes, programmable consumer electronics, wireless communication devices, wireline communication devices, network PCs, minicomputers, mainframe computers, distributed computing environments that include any of the above systems or devices, and the like.

Certain features supporting the dual-pass pitch tracking module of the innovative audio analyzer may well be described in the general context of computer-executable instructions, such as program modules, being executed by a computer. Generally, program modules include routines, programs, objects, components, data structures, etc. that perform particular tasks or implement particular abstract data types.

As shown in FIG. 1, the computing environment 100 includes a general-purpose computing device in the form of a computer 102. The components of computer 102 may include, but are not limited to, one or more processors or execution units 104, a system memory 106, and a bus 108 that couples various system components including the system memory 106 to the processor 104.

As shown, system memory 106 includes computer readable media in the form of volatile memory 110, such as random access memory (RAM), and/or non-volatile memory 112, such as read only memory (ROM). The non-volatile memory 112 includes a basic input/output system (BIOS), while the volatile memory typically includes an operating system 126, application programs 128 such as, for example, audio analyzer 129, other program modules 130 and program data 132. Insofar as the instructions and data stored in volatile memory are lost when power is removed from the computing system, such information is commonly stored in a non-volatile mass storage such as removable/non-removable, volatile/non-volatile computer storage media 116, accessible via data media interface 124. By way of example only, a hard disk drive, a magnetic disk drive (e.g., a "floppy disk"), and/or an optical disk drive may also be implemented on computing system 102 without deviating from the scope of the invention. Moreover, it should be appreciated by those skilled in the art that other types of computer readable media which can store data that is accessible by a computer, such as magnetic cassettes, flash memory cards, digital video disks, random access memories (RAMs), read only memories (ROM), and the like, may also be used in the exemplary operating environment.

Bus 108 is intended to represent one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus also known as Mezzanine bus.

A user may enter commands and information into computer 102 through input devices such as keyboard 134 and/or a pointing device (such as a "mouse") 136 via an input/output interface(s) 140. Other input devices 138 may include a microphone, joystick, game pad, satellite dish, serial port, scanner, or the like, coupled to bus 1008 via input/output (I/O) interface(s) 140.

Display device 142 is intended to represent any of a number of display devices known in the art. A monitor or other type of display device 142 is typically connected to bus 108 via an interface, such as a video adapter 144. In addition to the monitor, certain computer systems may well include other peripheral output devices such as speakers (not shown) and printers 146, which may be connected through output peripheral interface(s) 140.

As shown, computer 102 may operate in a networked environment using logical connections to one or more remote computers via one or more I/O interface(s) 140 and/or network interface(s) 154.

Example Audio Analyzer

Figure 2:
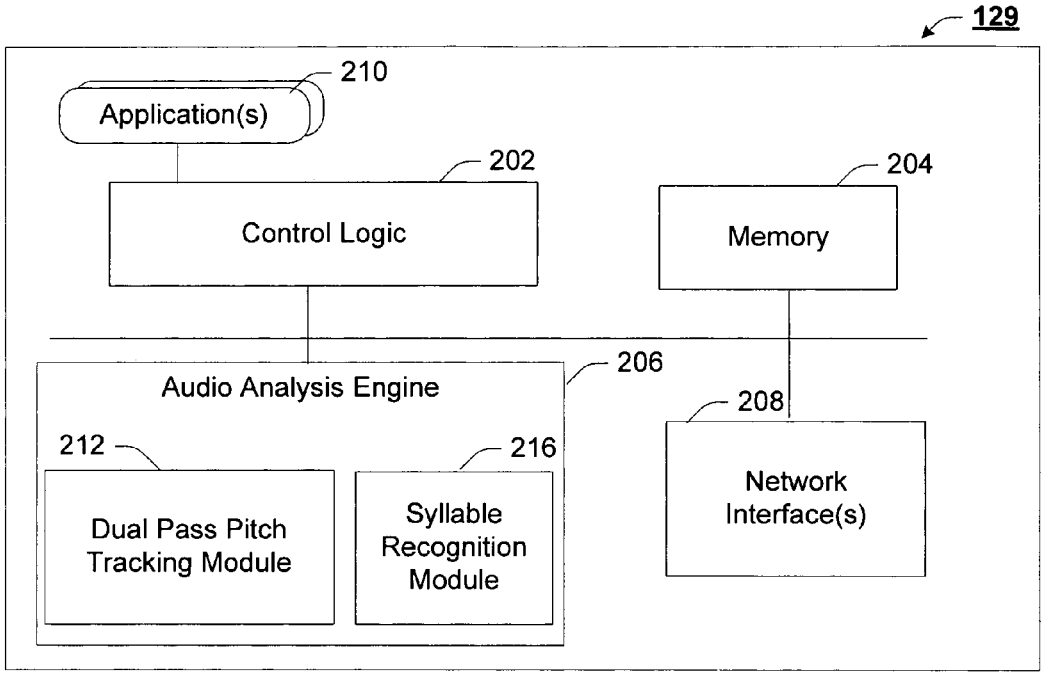
FIG. 2 is a block diagram of an example audio analyzer, in accordance with the teachings of the present invention.

FIG. 2 illustrates a block diagram of an example audio analyzer 129, which selectively implements one or more elements of a dual-pass pitch tracking system (FIG. 3), to be discussed more fully below. Although introduced as a stand-alone element within computing system 100, it is to be appreciated that audio analyzer 129 may well be integrated with or leveraged by any of a host of applications (e.g., a speech recognition system) to provide substantially real-time pitch tracking capability to such applications.

In accordance with the illustrated exemplary implementation of FIG. 2, audio analyzer 129 is depicted comprising one or more controllers 202, memory 204, an audio analysis engine 206, network communication interface(s) 208 and one or more applications (e.g., graphical user interface, speech recognition application, language conversion application, etc.) 210, each communicatively coupled as shown. It will be appreciated that although depicted in FIG. 2 as a number of disparate blocks, one or more of the functional elements of the audio analyzer 129 may well be combined/integrated into multifunction modules. Moreover, although depicted in accordance with a hardware paradigm, those skilled in the art will appreciate that this is for ease of explanation only, and that such functional modules may well be implemented in software and/or firmware without deviating from the spirit and scope of the present invention.

As alluded to above, although depicted as a separate functional element, audio analyzer 129 may well be implemented as a function of a higher-level application, e.g., a word processor, web browser, speech recognition system, or a language conversion system. In this regard, controller(s) 202 of analyzer 129 are responsive to one or more instructional commands from a parent application to selectively invoke the pitch tracking features of audio analyzer 129. Alternatively, analyzer 129 may well be implemented as a stand-alone analysis tool, providing a user with a user interface (e.g., 210) to selectively implement the pitch tracking features of audio analyzer 129, discussed below.

In either case, controller(s) 202 of analyzer 129 receives audio input and selectively invokes one or more functions of analysis engine 206 (described more fully below) to identify a most likely fundamental frequency within each of a plurality of frames of parsed audio input. According to one implementation, the audio content is receive into memory 204, which then supplies audio analysis engine 206 with select subsets of the received audio, as controlled by controller(s) 202. Alternatively, controller 202 may well direct received audio content directly to the audio analysis engine 206 for pitch tracking analysis.

Except as configured to effect the teachings of the present invention, controller 202 is intended to represent any of a number of alternate control systems known in the art including, but not limited to, a microprocessor, a programmable logic array (PLA), a micro-machine, an application specific integrated circuit (ASIC) and the like. In an alternate implementation, controller 202 is intended to represent a series of executable instructions to implement the control logic described above.

As shown, the innovative audio analysis engine 206 is comprised of at least a dual-pass pitch tracking module 212. In certain implementations, the audio analysis engine 206 may also be endowed with another functional element which leverages the features of the innovative dual-pass pitch tracking module 212 to foster different audio analyses such as, for example speech recognition. In this regard, audio analysis engine 206 is depicted comprising syllable recognition module 216.

As used herein, syllable recognition module 216 is depicted to illustrate that other functional elements may well be implemented within (or external to) audio analysis engine 206 to leverage the pitch detection attributes of dual-pass pitch tracking module 212. In accordance with the illustrated exemplary implementation, syllable recognition module 216 analyzes received audio content to detect phonemes, the smallest audio element of verbal communication, and compares the detected phonemes against a language model in an attempt to detect the content of verbal communication. When implemented in conjunction with the innovative dual-pass pitch tracking module 212, the syllable recognition module 216 utilizes the pitch tracking features to discern audio content in tonal language input. It is to be appreciated that the dual pass pitch tracking module 212 functions independently of syllable recognition module 216. Indeed, audio analysis engine 206 may well be endowed with other audio analysis functions that leverage the pitch tracking features of dual-pass pitch tracking module 212 in place of/addition to syllable recognition module 216.

As will be described more fully below, dual-pass pitch tracking module 212 receives audio content, pre-processes it to parse the audio content into frames, and proceeds to pass the frames of audio content through a first and second pitch estimation module to identify the fundamental frequency of the audio content within each frame. That is, dual-pass pitch tracking module implements two separate pitch estimation modules to identify the fundamental frequency of a frame of audio content. One exemplary architecture for just such a dual-pass pitch tracking module 212 is presented below, with reference to FIG. 3.

In addition to the foregoing, audio analyzer 129 also includes one or more network communication interface(s) 208 and may also include one or more applications 210. According to one implementation, network interface(s) 208 enable audio analyzer 129 to interface with external elements such as, for example, external applications, external hardware elements, one or more internal busses of a host computing system and/or one or more inter-computing system networks (e.g., local area network (LAN), wide area network (WAN), global area network (Internet), and the like). As used herein, network interface(s) 208 is intended to represent any of a number of network interface(s) known in the art and, therefore, need not be further described.

Figure 3:
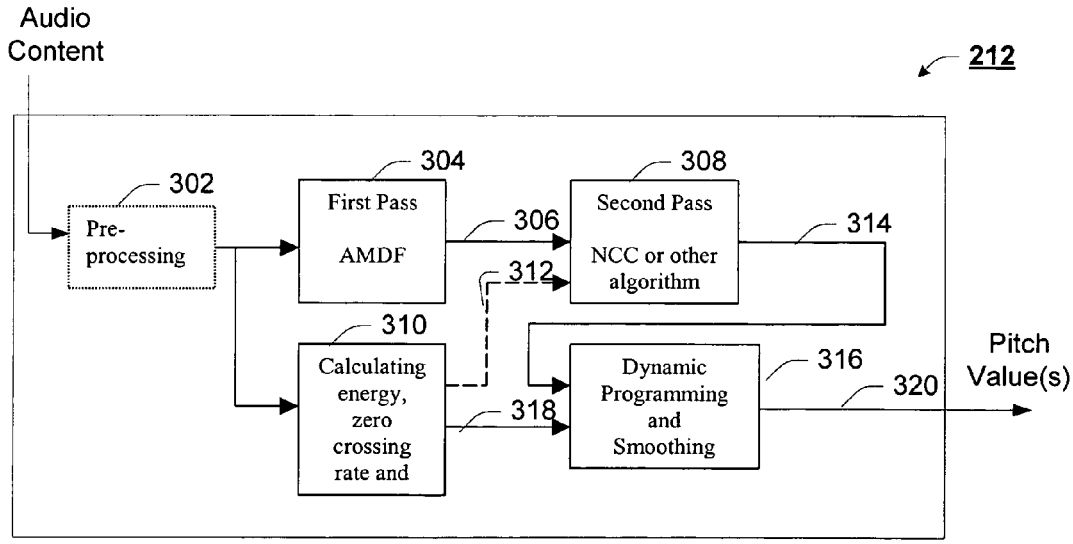
FIG. 3 is a block diagram of an example dual-pass pitch tracking module, according to certain aspects of the present invention.

Turning to FIG. 3, a block diagram of an example dual-pass pitch tracking module is presented, in accordance with certain exemplary implementations of the present invention. In accordance with the illustrated exemplary implementation of FIG. 3, dual-pass pitch tracking module 206 is presented comprising a pre-processing module 302, a first pitch estimation module 304, a second pitch estimation module 308, a zero crossing/energy detection module 310 and one or more filters 316, each coupled as shown. It should be noted that pre-processing module 302 is depicted herein using a lighter, hashed line to denote that the dual-pass pitch tracking module may well function without pre-processing. As used herein, pre-processing module parses the received audio content into frames of audio content. According to one implementation, the frame size is pre-defined to ten (10) milliseconds worth of audio content. In alternate implementations, other frame sizes may well be used, or the frame size may well be dynamically set based, at least in part, on one or more features of the received audio content, e.g., overall duration of audio, sampling rate, dynamic range, etc.

In addition to parsing the received audio content, pre-processing module 302 beneficially removes some background noise and some components for the received audio content with unreasonable frequencies in the frequency domain. In this regard, pre-processing module 302 may well implement some filtering functions to remove such undesirable audio content. In addition, pre-processing module 302 estimates and removes a direct-current (DC) bias from each of the frames before passing the content to the pitch estimation modules.

Once parsed, each frame of the audio content is passed through a first pitch estimation module 304, filtered, and then passed through a second pitch estimation module 308 before additional filtering and smoothing 316 to reveal a probable fundamental frequency (pitch value) 320 for the frame. According to one implementation, the first pitch estimation module 304 implements a fast pitch estimation algorithm to identify an initial set of pitch value candidates. The plethora of pitch value candidates identified by the first pitch estimation module are then filtered to a more manageable number of candidates 306, which are passed through a second pitch estimation module 308.

According to one implementation, the second pitch estimation module 308 implements a more accurate pitch estimation algorithm than the first pitch estimation algorithm. In this regard, the increased computational complexity of the second estimation module 308 may slow the performance of the module when compared to the first 304. Insofar as the second pitch estimation module is acting on a smaller sample size (i.e., the filtered candidates 306 from the first pitch estimation module 304), the processing time is about the same or slightly less than the processing required by the first module 304. In this regard, the dual-pass pitch detection module 212 functions to provide an accurate and fast pitch detection capability, suitable for applications requiring substantially real-time pitch detection.

According to one implementation, to be described more fully below, the first pitch estimation module 304 implements an average magnitude difference function (AMDF) pitch estimation algorithm, presented mathematically in equation 1, below.

$$D_{i,k} = \sum_{j=m}^{m+n-1} |s_j - s_{j+k}|, k = 0, 1, L, K-1 \quad (1)$$

where: $s_j$ and $s_{j+k}$ are the $j^{th}$ and $(j+k)^{th}$ sample in the speech waveform, and $D_{j,k}$ represents the similarity of the $i^{th}$ speech frame and its adjacent neighbor with an interval of k samples.

The AMDF pitch estimation algorithm derives its performance capability from the fact that it is performing a subtraction operation which, those skilled in the art will appreciate is faster to execute than other more complex operations such as multiplication, division, logarithmic functions, and the like. Thus, even though the first pitch estimation module 304 is acting on the entire sample, implementation of the AMDF algorithm nonetheless enables module 304 to perform this function quite rapidly.

As introduced above, the AMDF algorithm is employed by pitch estimation module 304 to find potential pitch value candidates within a frame shift range of 2 ms to 20 ms. According to certain exemplary implementations, N possible pitch values are estimated, where N is based, at least in part, on the speech sampling rate (R), wherein N=(shift time range)*R. For example, in the case where the speech sampling rate (R) is 16 kHz, N=288 pitch values are calculated and filtered, to provide an initial set of M pitch value candidates (306) to the second pitch estimation module 308. In accordance with the illustrated exemplary implementation, N>>M. The M top candidates are selected by sorting the possible pitch candidates according to the AMDF score in the current frame and selecting the top M candidates in this implementation.

According to one implementation, the second pitch estimation module 308 implements a normalized cross correlation (NCC) pitch estimation algorithm to re-score the top M pitch value candidates from the first pitch estimation module 304, expressed mathematically with reference to equations (2) and (3), below.

$$\phi_{i,k} = \frac{\sum_{j=m}^{m+n-1} s_j s_{j+k}}{\sqrt{e_m e_{m+k}}}, k = 0, 1, L, K-1; i = 0, 1, L, M-1 \quad (2)$$

where: (3)

$$e_m = \sum_{l=m}^{m+n-1} S_l^2$$

Because the value of the NCC pitch estimation function is independent of the amplitude of adjacent audio frames, the second pitch estimation module 308 overcomes the accuracy shortcomings of other pitch estimators, but at a cost of computational complexity. Accordingly, as implemented herein, the second pitch estimation module 308 receives a smaller sample size to act upon than does the first pitch estimation module 304, i.e., N>>M. The result of which is a computationally efficient, while accurate pitch tracking module 212.

Again, the result of the second pitch estimation module 308, the re-scored candidates are passed through dynamic programming and smoothing module 316 which selects the best primary pitch and voicing state candidates at each frame based, at least in part, on a combination of local and transition costs. As used herein, the "local cost" is the pitch candidate ranking score generated through the dual pass pitch estimation modules 304, 308. The "transition costs" include one or more ratios of energy, zero crossing rate, Itakura distances and the difference of fundamental frequency between the current and adjacent audio frames 318 computed in module 310. Exemplary formulations of "transition costs" are provided below in equations (4), (5), (6), and (7).

Firstly, we assume the length of each speech waveform frame is T. For k th frame, we define the following variables:

$$rms(k) = \sum_{i=k*T+1}^{(k+1)*T} x_k^2$$

$$rr(k)=rms(k)/rms(k-1)$$

$$Pow(k)=\alpha_k^T R_k \alpha_k$$

$$S(k)=Pow(k)/Pow(k-1)$$

$$zcross(k)\text{–The Number of Zero Cross In This Frame}$$

$$cc(k)=zcross(k)/zcross(k-1)$$

$$SNR(k)=rms(k)/rms'$$

Where, x(t) is the amplitude if speech waveform on time t, and rr (k)>1 if the k th frame of signal is on the location of the beginning of a voiced segment, otherwise, rr (k)<1. $\alpha_k$ is the linear prediction coefficients, and $R_k$ is the autocorrelation matrix, k th frame is like to (k−1) th one if S (k) is close to 1. cc(k) is zero-cross rate, and it will be larger then 1 when from voiced or silence segment to unvoiced segment. rms is the average energy of background, SNR(k) is signal noise ratio of this frame.

In the dynamic programming procedure, four kinds of transition cost should be considered:

1. cost A: from voiced segment to voiced one.
2. cost B: from unvoiced segment to voiced one.
3. cost C: from voiced segment to unvoiced one.
4. cost D: from unvoiced segment to unvoiced one.

In fact, we assume each frame of signal can be either voiced or unvoiced, and calculate the cost in every possible case. At last, we will determine the pitch value with the optimal cost (in this case, optimal cost is the maximum cost consisting of transition cost or value and NCC value).

The formula of each kind of transition cost is listed as following:

$$Trans_A=W_{a1}*abs(\text{Candidate}(k)-\text{Candidate}(k-1)) \quad (4)$$

$$Trans_B=W_{b1}abs(rr(k)*S(k))+W_{b2}*cc(k)+W_{b3}/SNR(k) \quad (5)$$

$$Trans_C=W_{c1}*abs(rr(k)*S(k))+W_{c2}*(rr(k)-1)+W_{c3}*cc(k) \quad (6)$$

$$Trans_D=W_{d1}+W_{d2}\text{Log}(S(k)) \quad (7)$$

In above formula, all items name as W* are constants that may be determined by experiments.

Example Waveform and Pitch Tracking Result

Figure 4:
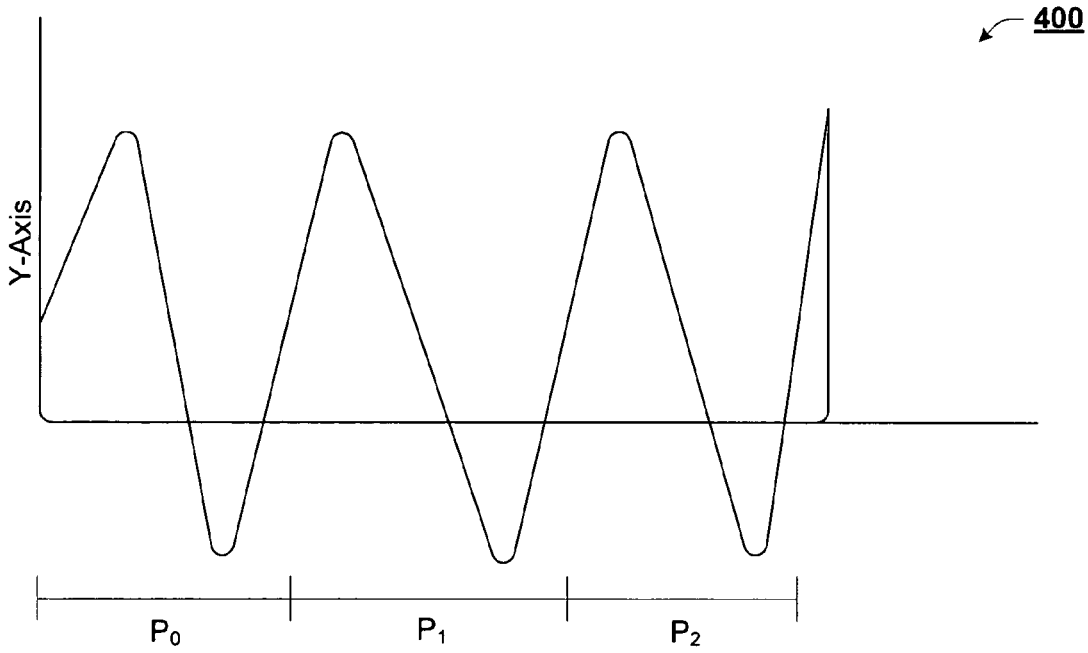
FIG. 4 is a graphical illustration of an example waveform of audio content broken into individual pitch periods.
Figure 5:
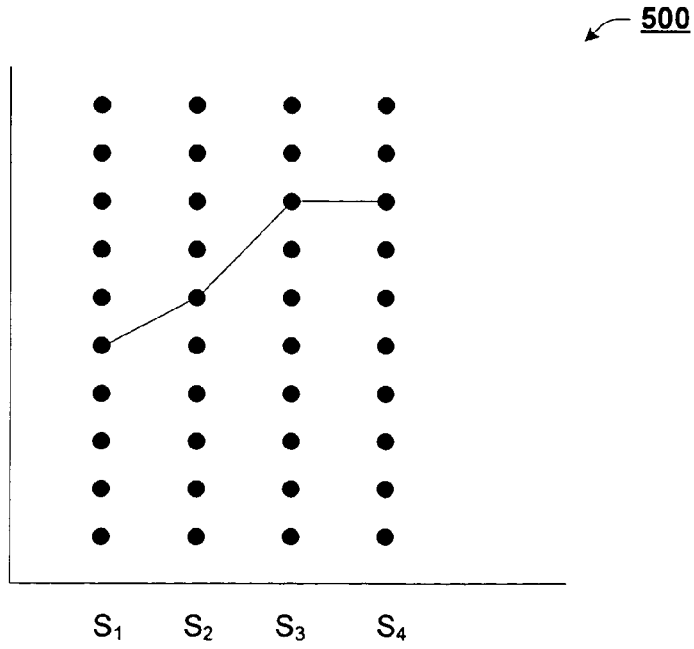
FIG. 5 is a graphical illustration of chart depicting the digitized spectrum of each of the pitch periods, from which the pitch tracking module calculates the relative probability for transition between discrete candidates within each pitch period.

FIGS. 4 and 5 are presented to illustrate the functional operation of dual-pass pitch tracking module 212. With initial reference to FIG. 4, an illustration of an example audio waveform 400 is presented. For ease of illustration, three (3) periods of the waveform are illustrated, i.e., $P_0$, $P_1$ and $P_2$. The period of an audio signal is not to be confused with frame size selection, i.e., one period of a signal does not necessarily equate to a parsed frame. Signals such as the one depicted in FIG. 4 are applied to dual-pass pitch tracking module 212, which extracts pitch value information, and tracks such information across frames.

The pitch selection and tracking features of pitch detection module 212 is graphically illustrated with reference to FIG. 5. With brief reference to FIG. 5, a spectral diagram of the identified pitch values within each of a number of frames are depicted wherein the solid line between pitch value candidates denote those candidates that were selected as the most likely candidate based, at least in part, on the local and transition costs.

Example Operation and Implementation

Figure 6:
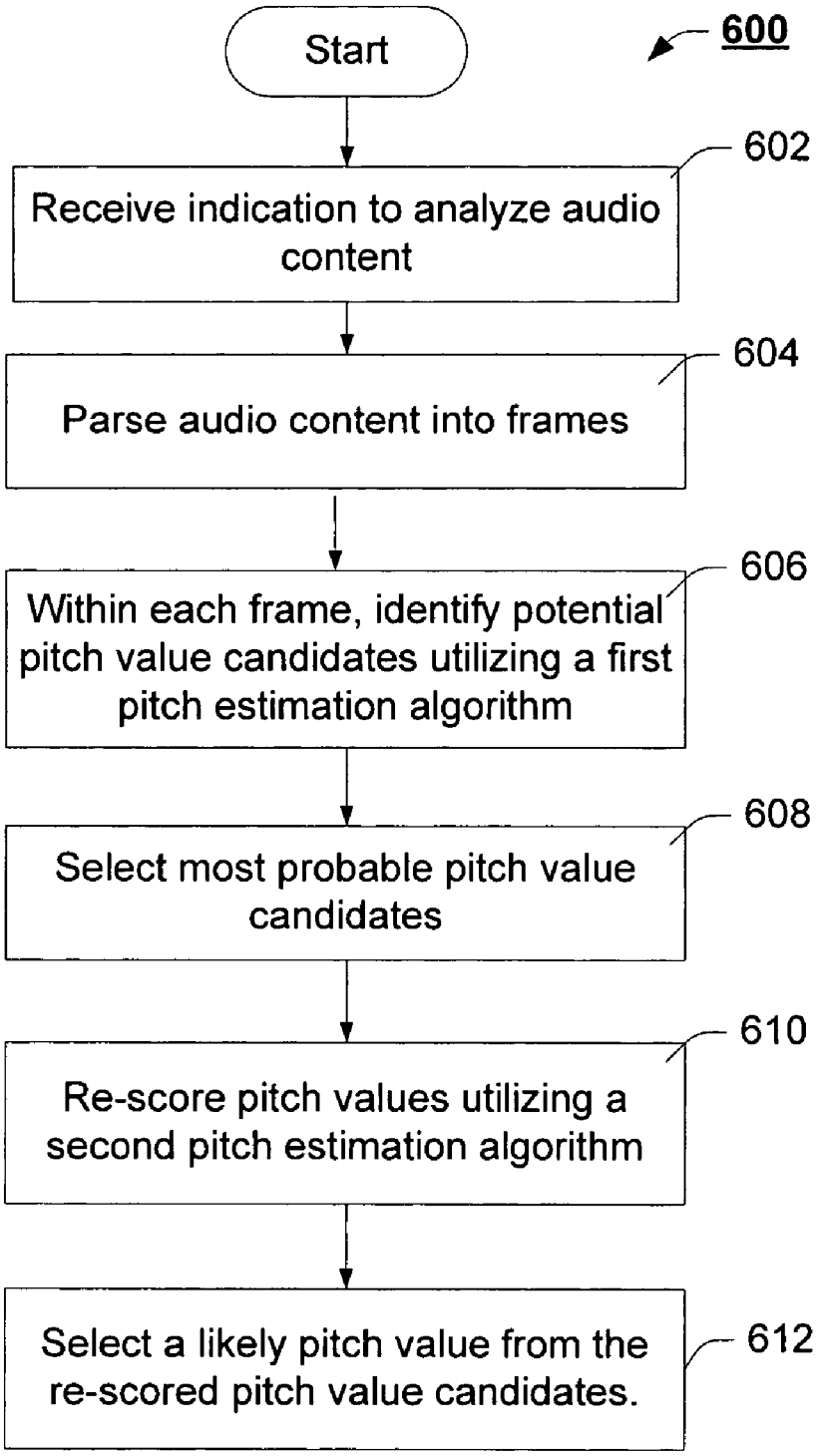
FIG. 6 is a flow chart of an example method for tracking pitch in substantially real-time, according to certain aspects of the present invention.

Having introduced the functional and architectural elements of the dual-pass pitch tracking module 212, an example operation and implementation is developed with reference to FIG. 6. For ease of illustration, and not limitation, the teachings of the present invention will be illustrated with continued reference to the elements of FIGS. 1–5.

FIG. 6 is a flow chart of an example method for detecting pitch values in received audio content, according to one implementation of the present invention. As shown, the method of FIG. 6 begins with block 602, wherein audio analyzer 129 receives an indication to analyze audio content. As introduced above, the indication may well be generated by a separate application, e.g., a user interface application executing on a host computing system (100), or may well come from an interface executing on audio analyzer 129 itself.

In response to receiving such an indication, audio controller 202 of audio analyzer 129 opens one or more network communication interface(s) 208 to receive the audio content. As disclosed above, according to one implementation, the audio content may well be received in memory 204 of audio analyzer 129, and is selectively fed to dual-pass pitch tracking module 212 for analysis by controller 202.

As audio analyzer 129 begins to receive audio content, controller 202 selectively invokes an instance of dual-pass pitch tracking module 212 with which to analyze the audio content and extract pitch value information. As disclosed above, according to one implementation, dual-pass pitch tracking module 212 invokes an instance of pre-processing module 302 to parse the received content into frames, eliminate any DC bias from the audio signal, and remove undesirable noise artifacts from the received signal, block 604.

In block 606, the filtered audio signal frames are provided to a first pitch estimation module 304, which identifies a first set of pitch value candidates. According to one implementation, the first pitch estimation module 304 employs an average magnitude difference function (AMDF) pitch extractor to identify N pitch value candidates. As disclosed above, the number of candidates generated (N) is based, at least in part, on the sample rate of the audio content. Once the initial N candidates are identified, the candidates are filtered, and the most probable M candidates 306 are selected for re-scoring by the second pitch estimation module 308, block 608.

Accordingly, in block 610 a second pitch estimation module 308 is invoked to re-score the M pitch value candidates. As introduced above, the second pitch value estimation module 308 employs a more robust pitch value estimation algorithm than the first pitch estimation module. An example of just such robust pitch estimation algorithm suitable for use in the second pitch estimation module 308 is the normalized cross-correlation (NCC) pitch extractor introduced above.

As described above, passing each frame of audio content through each of the first 304 and second 308 pitch estimation modules generates a local score for each of the top pitch value candidates within each frame. In addition to the local score, dual-pass pitch tracking module 212 selectively calculates 310 a transition score 318 for each of the candidates as well. As introduced above module 310 generates a transition score 318 based on a ratio of any of a number of signal parameters between frames of the received audio signal. The generated local and transition scores are provided to dynamic programming and smoothing module 316, which selects the best pitch value candidate based on these scores, block 612.

It is to be appreciated that the dual-pass pitch tracking system introduced above provides an effective solution to the problem of generating accurate pitch value candidates in substantially real-time. By leveraging the speed of the first pitch estimation function and the acoustic accuracy of the second pitch estimation module, a computationally efficient and accurate pitch detection system is created.

Alternate Implementations—Computer Readable Media

Figure 7:
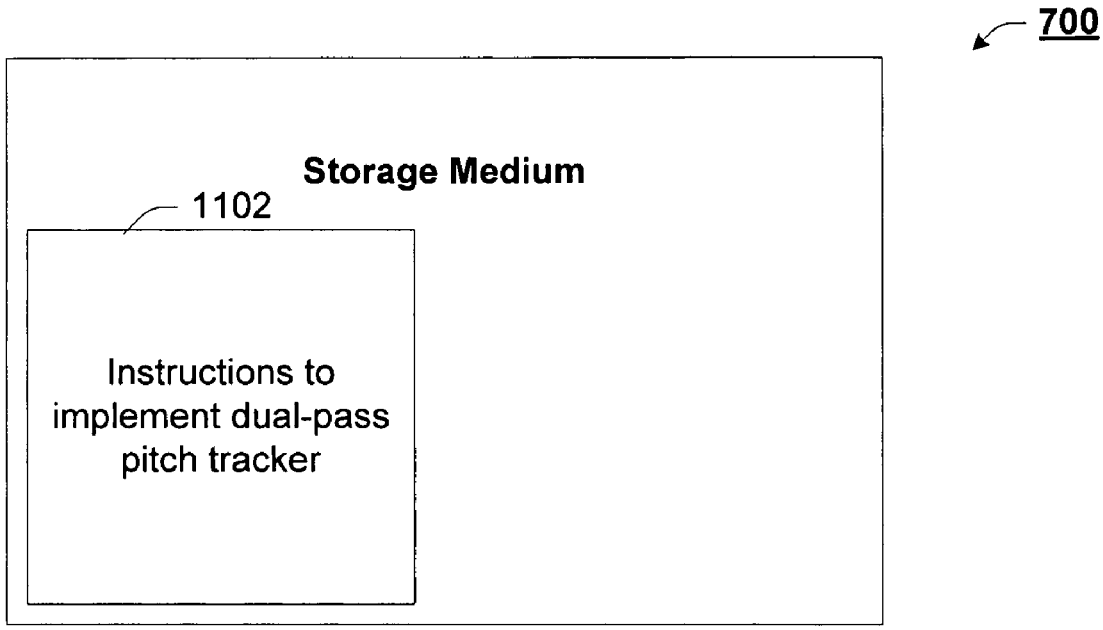
FIG. 7 is a graphical illustration of an example storage medium including instructions which, when executed, implement the teachings of the present invention, according to certain implementations of the present invention.

Turning to FIG. 7, an implementation of one or more elements of the architecture and related methods for streaming content across heterogeneous network elements may be stored on, or transmitted across, some form of computer readable media in the form of computer executable instructions. According to one implementation, for example, instructions 702 which when executed implement at least the dual-pass pitch tracking module may well be embodied in computer-executable instructions. As used herein, computer readable media can be any available media that can be accessed by a computer. By way of example, and not limitation, computer readable media may comprise "computer storage media" and "communications media."

As used herein, "computer storage media" include volatile and non-volatile, removable and non-removable media implemented in any method or technology for storage of information such as computer readable instructions, data structures, program modules, or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

"Communication media" typically embodies computer readable instructions, data structures, program modules, or other data in a modulated data signal, such as carrier wave or other transport mechanism. Communication media also includes any information delivery media.

The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above are also included within the scope of computer readable media.

FIG. 7 is a block diagram of a storage medium 700 having stored thereon a plurality of instructions including instructions 702 which, when executed, implement a dual-pass pitch tracking module 206 according to yet another implementation of the present invention. As used herein, storage medium 700 is intended to represent any of a number of storage devices and/or storage media known to those skilled in the art such as, for example, volatile memory devices, non-volatile memory devices, magnetic storage media, optical storage media, and the like. Similarly, the executable instructions are intended to reflect any of a number of software languages known in the art such as, for example, C++, Visual Basic, Hypertext Markup Language (HTML), Java, eXtensible Markup Language (XML), and the like. Accordingly, the software implementation of FIG. 7 is to be regarded as illustrative, as alternate storage media and software implementations are anticipated within the spirit and scope of the present invention.

Although the invention has been described in language specific to structural features and/or methodological steps, it is to be understood that the invention defined in the appended claims is not necessarily limited to the specific features or steps described. It will be appreciated, given the foregoing, that the teachings of the present invention extend beyond the illustrative exemplary implementations presented above.

The invention claimed is:

1. A method comprising:

identifying an initial set of pitch value candidates within each frame of a plurality of frames of received audio content utilizing a first pitch estimation algorithm;

reducing the initial set of pitch value candidates to a select set of select pitch value candidates based, at least in part, on pitch value re-scoring utilizing a second pitch estimation algorithm, wherein the select set of pitch values are selected in substantially real-time; and associating at least some of the select pitch value candidates with at least one speech phoneme in substantially real-time:

wherein identifying the initial set of pitch values candidates within each frame comprises: passing each frame of audio content through an average magnitude difference function (AMDF); and selecting N near-zero minima pitch values in the audio content as the initial set of pitch values; and wherein identifying a select set of pitch values comprises: generating a local score for each of the initial set of pitch values utilizing a normalized cross-correlation function (NCCF); and selecting M pitch values with the highest local score.

2. The method as recited in claim 1, wherein the associating further comprises calculating a transition probability between one of the select pitch value candidates and a select pitch value candidate of an adjacent frame of audio content; and selecting a pitch value within each frame with the highest transition probability between adjacent frames as the pitch value for the frame.

3. The method as recited in claim 2, wherein the transition probability is based, at least in part, on dynamic programming configured to determine a significantly best path between different pitch candidates of adjacent frames.

4. The method as recited in claim 2, further comprising smoothing a curve representing the select pitch values over a plurality of frames based at least in part on other information, wherein the other information includes one or more of an energy value for each frame, a zero crossing rate of the audio content, and/or a vocal tract spectrum of the audio content.

5. The method as recited in claim 1, wherein N is set to 288 pitch value candidates, selected as the initial set of pitch value candidates based, at least in part, on the AMDF.

6. The method as recited in claim 1, further comprising comparing a sequence of multiple phonemes associated with corresponding select pitch value candidates from multiple adjacent frames of the audio content with a language model to determine a syllable of speech in substantially real time.

7. The method as recited in claim 6, wherein the language model comprises at least in part one or more syllable-based speech and text corpora.

8. The method as recited in claim 1, further comprising comparing a temporal sequence of the phonemes corresponding to adjacent frames of the audio content with a language model to determine a syllable of speech in substantially real time.

9. A computer readable medium having computer instructions for performing acts comprising:

identifying an initial set of pitch values within frames of audio content utilizing a first pitch estimation algorithm;

reducing the initial set of pitch values to a select set of pitch values based, at least in part, on pitch value re-scoring utilizing a second pitch estimation algorithm, wherein the select set of pitch values are determined in substantially real-time;

associating at least some of the pitch values from the select set with at least one speech phoneme in substantially real-time;

wherein identifying the initial set of pitch values within each frame comprises: passing each frame of audio content through an average magnitude difference function (AMDF); and selecting N near-zero minima pitch values in the audio content as the initial set of pitch values; and wherein identifying a select set of pitch values comprises: generating a local score for each of the initial set of pitch values utilizing a normalized cross-correlation function (NCCF); and selecting M pitch values with the highest local score.

10. A computer readable medium as recited in claim 9, having further computer instructions for performing acts comprising:

calculating a transition probability between at least one of the pitch values of adjacent frames.

11. A computer readable medium as recited in claim 9, having further computer instructions for performing acts comprising:

within each frame of audio content, selecting a pitch value with the highest transition probability between adjacent frames as the pitch value representing the pitch of the frame.

12. A computer readable medium as recited in claim 9, wherein the transition probability is based, at least in part, on dynamic programming configured to determine a significantly best path between different pitch values of adjacent frames.

13. A computer readable medium as recited in claim 9, having further computer instructions for performing acts comprising:

smoothing a curve representing the pitch values of the select set over a plurality of frames based, at least in part, on other information.

14. A computer readable medium as recited in claim 13, wherein the other information includes one or more of an energy value for each frame, a zero crossing rate of the audio content, and/or a vocal tract spectrum of the audio content.

15. A computer readable medium as recited in claim 9, wherein N is set to 288 pitch value candidates, selected as the initial set of pitch values based, at least in part, on the AMDF.

16. A computer readable medium as recited in claim 9, further comprising instructions to compare a sequence of multiple phonemes associated with corresponding select pitch value candidates from multiple adjacent frames of the audio content with a language model to determine a syllable of speech in substantially real time.

17. A computer readable medium as recited in claim 16, wherein the language model comprises at least in part one or more syllable-based speech and text corpora.

18. A computer readable medium as recited in claim 16, further comprising instructions to compare a temporal sequence of the phonemes corresponding to adjacent frames of the audio content with a language model to determine a syllable of speech in substantially real time.

19. An audio analysis engine, comprising:

a pitch tracker to:

receive audio content;

identify an initial set of pitch value candidates within each frame of a plurality of frames of the received audio content utilizing a first pitch estimation algorithm;

reduce the initial set of pitch value candidates to a select set of pitch value candidates based, at least in part, on pitch value re-scoring utilizing a second pitch estimation algorithm, wherein the select set of pitch values are selected in substantially real-time;

a syllable recognition module to associate at least some of the select pitch value candidates determined by the pitch tracker with at least one speech phoneme in substantially real-time;

wherein, in response to identifying the initial set of pitch value candidates within each frame, the pitch tracker passes each frame of audio content through an average magnitude difference function (AMDF), and selects N near-zero minima pitch values in the audio content as the initial set of pitch value candidates; and wherein, in response to identifying the select set of pitch values, the pitch tracker generates a local score for each of the initial set of pitch value candidates utilizing a normalized cross-correlation function (NCCF), and selects M pitch value candidates with the highest local score.

20. The audio analysis engine as recited in claim 19, wherein the transition probability is based, at least in part, on dynamic programming configured to determine a significantly best path between different pitch candidates of adjacent frames.

21. The audio analysis engine as recited in claim 20, wherein the pitch tracker smoothes a curve representing the select pitch values over a plurality of frames based, at least in part, on other information.

22. The audio analysis engine as recited in claim 21, wherein the other information includes one or more of an energy value for each frame, a zero crossing rate of the audio content, and/or a vocal tract spectrum of the audio content.

23. The audio analysis engine as recited in claim 19, wherein N is set to 288 pitch value candidates, selected as the initial set of pitch value candidates based, at least in part, on the AMDF.

24. The audio analysis engine as recited in claim 19, wherein the syllable recognition module compares a sequence of multiple phonemes associated with corresponding select pitch value candidates from multiple adjacent frames of the audio content with a language model to determine a syllable of speech in substantially real time.

25. The audio analysis engine as recited in claim 24, wherein the language model comprises at least in part one or more syllable-based speech and text corpora.

26. The audio analysis engine as recited in claim 19, wherein the syllable recognition module compares a temporal sequence of the phonemes corresponding to adjacent frames of the audio content with a language model to determine a syllable of speech in substantially real time.

27. The audio analysis engine as recited in claim 19, wherein the pitch tracker calculates a transition probability between at least one of the select pitch value candidates of adjacent frames and selects a pitch value within each frame with the highest transition probability between adjacent frames as the pitch value for the frame.

* * * * *